US005299879A

United States Patent [19]

Burrow

[11] Patent Number: 5,299,879

[45] Date of Patent: Apr. 5, 1994

[54] INDEX SHEET ASSEMBLY

[75] Inventor: Jimmie D. Burrow, Ballwin, Mo.

[73] Assignee: American Trading and Production Corporation, Baltimore, Md.

[21] Appl. No.: 947,743

[22] Filed: Sep. 21, 1992

[51] Int. Cl.[5] ..... B42F 21/00

[52] U.S. Cl. ..... 402/79; 281/42; 283/36

[58] Field of Search ..... 402/79, 80; 281/42, 281/51; 283/36, 37, 38

[56] References Cited

U.S. PATENT DOCUMENTS

| | | | |
|---|---|---|---|
| 694,001 | 2/1962 | Currier . | |
| 854,069 | 5/1967 | Williams . | |
| 1,243,626 | 10/1917 | Pinkerton . | |
| 1,492,932 | 5/1924 | Orrell | 402/79 X |
| 2,064,749 | 12/1936 | Huber . | |
| 2,291,573 | 7/1942 | Freifeld . | |
| 2,452,231 | 10/1948 | Dobie, Jr. . | |
| 2,962,335 | 11/1960 | Benson | 402/79 X |
| 4,580,814 | 4/1986 | Berler | 283/67 |
| 4,580,815 | 4/1986 | Barber | 283/81 |
| 4,715,621 | 12/1987 | Colavito et al. | 283/36 |
| 4,784,508 | 11/1988 | Shannon | 283/36 |
| 4,893,839 | 1/1990 | Podd et al. | 283/65 |
| 5,056,825 | 10/1991 | Templet | 283/36 |

*Primary Examiner*—Mark Rosenbaum
*Assistant Examiner*—Willmon Fridie, Jr.
*Attorney, Agent, or Firm*—Cohn, Powell & Hind

[57] ABSTRACT

This indexing system (10) for use with a binder (12) includes a plurality of section divider sheets (14) each having an outstanding tab (16) with index indicia thereon and a foldout index sheet assembly (18). The assembly (18) includes a carrier sheet (20) and a foldable index sheet (22) having foldout portion (24) provided with index indicia corresponding to the indicia on the tabs and an adjacent portion (26) attachable to the carrier sheet (20).

8 Claims, 1 Drawing Sheet

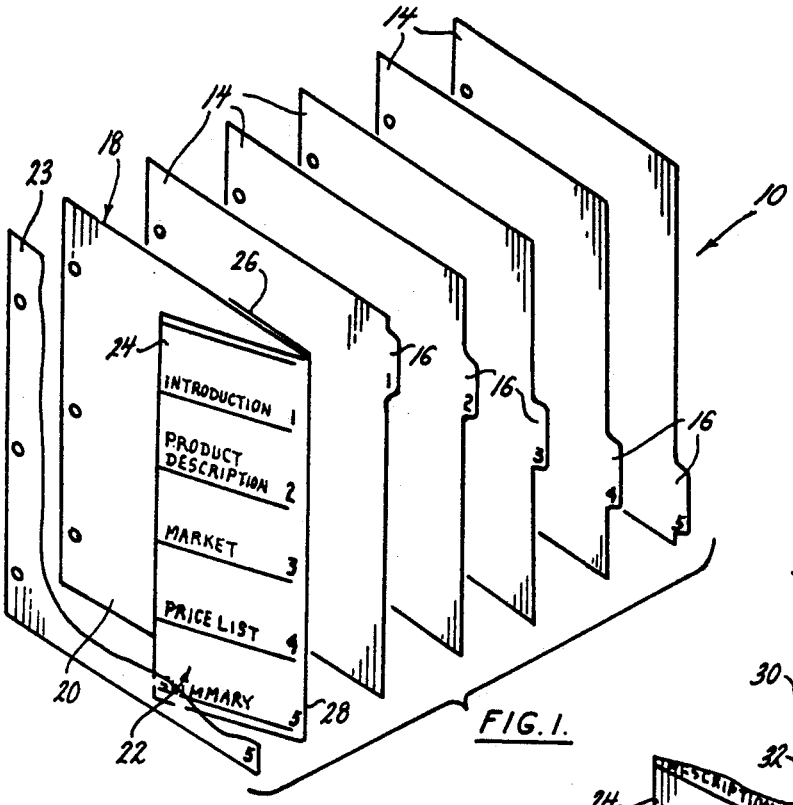
FIG. 1.
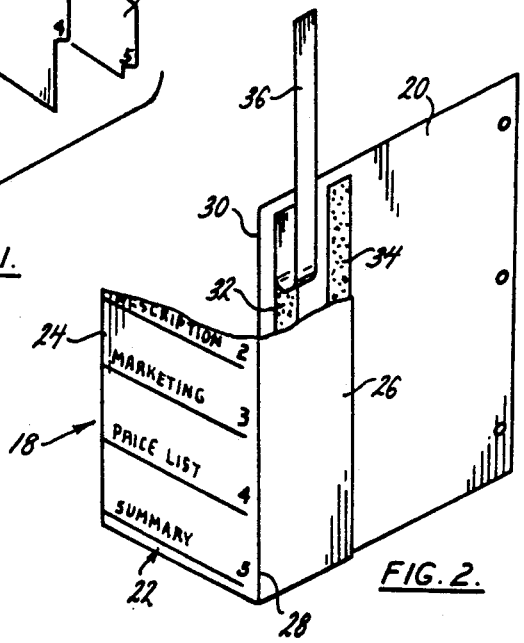
FIG. 2.
FIG. 3.
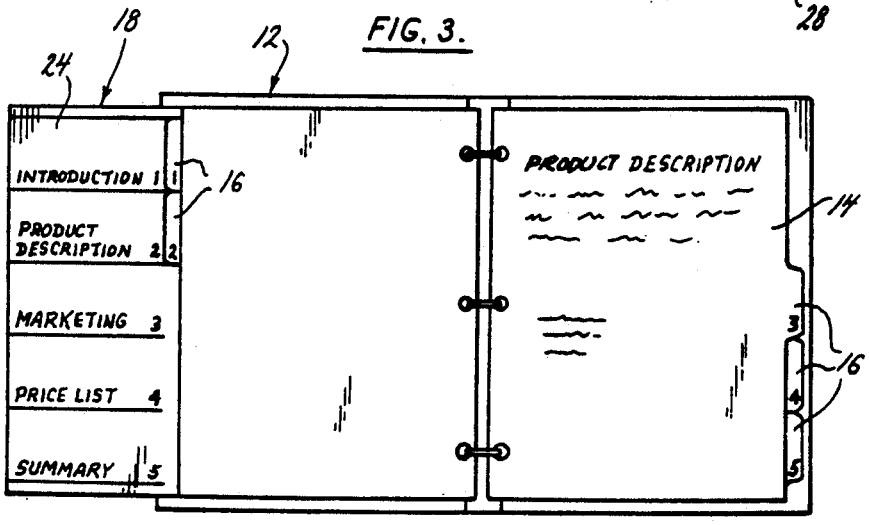

INDEX SHEET ASSEMBLY

BACKGROUND OF THE INVENTION

This invention relates generally to index sheets for binders and more particularly to an index sheet which can be moved into a visible position for review.

There are several ways of indexing binders, the most common probably being the provision of index information directly on tabs attached to section divider sheets. Another indexing system, which is more convenient, provides the divider tabs with indexing indicia such as sequencial numerals or letters and an index sheet which provides corresponding indicia and related index information aligned with the divider tabs. The latter system works well but suffers from the disadvantage that when the binder is open at a particular section the index sheet is hidden. Systems have been devised to provide index sheets which can be moved into a viewing position. For example, U.S. Pat. No. 4,893,839 provides a movable index sheet which is slotted and slidably mounted on tabs provided on a sandwiching base sheet. This system is relatively complex as are other systems such as disclosed in U.S. Pat. No. 2,291,573 in which an index is slidably concealed in the spine of the binder.

The present system overcomes these and other disadvantages in a manner not revealed in the known prior art.

SUMMARY OF THE INVENTION

This invention provides an index system which can be folded out from a binder for review when the binder is open and can be readily folded into a non-viewing position when not required.

It is an aspect of this invention to provide an indexing system for a binder, comprising a plurality of section divider sheets each having an outstanding tab with index indicia thereon, and an index sheet means including a carrier sheet and a foldable index sheet having first and second portions defined by a longitudinal fold line, said first portion having a sequence of index indicia corresponding to the index indicia on said tabs of said section divider sheets, and placeable in register with said index indicia on said tabs, and attachment means attaching said second portion to said carrier sheet so that said first portion is foldable out for review.

It is another aspect of this invention to provide that said attachment means includes an adhesive portion provided on one of said sheets, and another aspect to provide that said adhesive portion includes a peelable protective cover removable prior to attachment of said sheets.

It is still another aspect of this invention to provide that said adhesive portion includes two longitudinally spaced pressure sensitive adhesive strips disposed in spaced relation on said carrier sheet.

It is yet another aspect of this invention to provide that said carrier sheet and said foldable index sheet, prior to folding, are substantially the same size.

Another aspect of this invention is to provide a second nonfolded index sheet having a sequence of index indicia corresponding to the indicia on said tabs of said section divider sheets and in register with said indicia on said tabs.

This indexing system is inexpensive to manufacture, simple to use and efficient in operation.

BRIEF DESCRIPTION OF THE DRAWINGS

FIG. 1 is a perspective, exploded view of the indexing system;

FIG. 2 is a fragmentary perspective view showing the index sheet assembly, and

FIG. 3 is an elevational view showing the folded index sheet in use.

DESCRIPTION OF THE PREFERRED EMBODIMENT

Referring now by reference numerals to the drawings and first to FIG. 1 it will be understood that the indexing system 10 is intended for use in a binder such as the three-ring binder 12 and includes a plurality of section divider sheets 14 for separating the information in the binder into sections having appropriate headings. For example, a binder which includes promotional material for a new product could have "Table of Contents" information such as Introduction, Product Description, Marketing, etc.

In the embodiment shown, each of the divider sheets 14 each includes a tab 16 sequentially located and carrying indexing indicia such as numerals 1,2 etc. Except for the location and indicia on the tabs the divider sheets 14 are identical and, in the preferred embodiment are of a standard typing sheet size such as 8½"×11".

The indexing system includes an index sheet assembly 18, constituting an index sheet means and consisting of a carrier sheet 20 and a foldable index sheet 22. This index sheet 22 includes first and second portions 24 and 26 defined by a longitudinal fold line 28. The index sheet first portion 20 includes a sequence of index indicia corresponding to the index indicia on the tabs 16 and disposed at substantially the same longitudinal or vertical spacing as the indicia on said tabs. The folded index sheet 20 is disposed relative to the carrier sheet with the fold line 28 arranged to coincide with the outer margin 30 of the carrier sheet 22, and with the index indicia on the first portion of the index sheet perpendicularly or horizontally aligned and in register with the corresponding index indicia on the tabs 16. The second portion of the index sheet is attached to the carrier sheet so that it is foldable outwardly to provide a review extension index sheet which is visible when the binder is open at any section as indicated, for example, in FIG. 3.

In the preferred embodiment, as shown in FIG. 2, the attachment means between the index sheet second portion 26 and the carrier sheet 20 is provided by two longitudinal strips of pressure sensitive adhesive 32 and 34, which are disposed on the rear of the carrier sheet 20 and horizontally spaced apart to provide a secure attachment for the index sheet second portion 26. In the embodiment shown, the inner edge of the strip 34 is spaced from the margin 30 a distance substantially equal to the width of said second portion 26. Also, in the embodiment shown, the adhesive strips are each provided with a protective release cover 36 which is removed prior to constructing the index sheet assembly 18.

It is useful to provide a conventional, non-foldable index sheet, indicated by numeral 23 in FIG. 1, in addition to the foldable index sheet 22. As shown, the conventional index sheet 23 is disposed ahead of said foldable index sheet 22 and bears the identical information (not shown) as said index sheet 22. In those instances in which multiple copies of the foldable index sheet are required for multiple binders it has been found advantageous to provide guide lines and index indicia on master sheets printed in light blue or some other color which does not copy on a photocopy machine. When this is done the necessary index information can be typed on the master sheet and prepunched index sheets bearing the preprinted index indicia 1,2, etc. can be used for the actual copies. The information can be typed on the left side of the master sheet in the case of the foldable index sheet and on the right side in the case of the conventional index sheet.

It will be understood from FIG. 2 of the drawing that the foldable index sheet 22 need not be prefolded but can be readily attached to the rear face of the carrier sheet 20 by placing the right margin of the sheet 22 in register with the right margin of the inner adhesive strip 34, and by placing the upper and lower margins of the index sheet 22 in register with the corresponding carrier sheet margins and then pressing the index sheet into adhesive contact with the carrier sheet, said sheets being substantially identical in size. The index sheet 22 can then be reentrantly folded about the carrier sheet margin 30.

With the binder 12 open and the index sheet 22 in the foldout position, as shown in FIG. 3, it is a simple matter for the reader tomove to another section location by flipping the appropriate section divider tab 14 horizontally aligned with the corresponding index sheet information.

It will be understood that while a loose leaf binder is described the invention can be used with a permanent binder.

In view of the above it will be seen that various aspects and features of the invention are achieved and other advantageous results attained. While a preferred embodiment of the invention has been shown and described, it will be clear to those skilled in the art that changes and modifications may be made therein without departing from the invention in its broader aspects.

I claim as my invention:

1. An indexing system for a binder, comprising:
a plurality of section divider sheets each having a tab with index indicia thereon, and
an index sheet means including a carrier sheet and a foldable index sheet having first and second portions defined by a longitudinal fold line, said first portion having a sequence of index indicia corresponding to the index indicia on said tabs of said section divider sheets, and placeable in register with said index indicia on said tabs, and attachment means attaching said second portion to said carrier sheet so that said first portion is foldable out for review.

2. An indexing system as defined in claim 1, in which:
said attachment means includes an adhesive portion provided on at least one of said sheets.

3. An indexing system as defined in claim 2, in which:
said adhesive portion includes a peelable protective cover removable prior to attachment of said sheets.

4. An indexing system as defined in claim 2, in which:
said adhesive portion includes two longitudinally spaced pressure sensitive adhesive strips disposed in spaced relation on said carrier sheet.

5. An indexing system as defined in claim 1, in which:
said carrier sheet and said foldable index sheet, prior to folding, are substantially the same size.

6. An indexing system as defined in claim 1, in which:
a second non-folded index sheet is provided having a sequence of index indicia corresponding to the indicia on said tabs of said section divider sheets and in register with said indicia on said tabs.

7. An indexing system for a binder, comprising:
a plurality of section divider sheets each having an outstanding tab with index indicia thereon, and an index sheet means including a carrier sheet and a foldable index sheet having first and second portions defined by a longitudinal fold line, said first portion having a sequence of index indicia corresponding to the index indicia on said tabs of said section divider sheets and placeable in register with the indicia on said tabs, said carrier sheet including attachment means provided by a pair longitudinally extending adhesive strips disposed in spaced parallel relation and having a peelable protective cover removable prior to attachment of said sheets, said foldable index sheet second portion being attached to said carrier so that said first portion is foldable out for review,
said carrier sheet and said foldable index sheet, prior to folding, being substantially the same size.

8. An indexing system as defined in claim 7, in which:
a second, non-folded index sheet is provided having a sequence of index indicia corresponding to said index indicia on said foldable index sheet.

* * * * *